US007086157B2

(12) United States Patent
Vallotton

(10) Patent No.: US 7,086,157 B2
(45) Date of Patent: Aug. 8, 2006

(54) FOLDING KNIFE HAVING A BIASED BLADE

(75) Inventor: Alney K. Vallotton, Oakland, OR (US)

(73) Assignee: The Great American Tool Company Inc., Buffalo, NY (US)

( * ) Notice: Subject to any disclaimer, the term of this patent is extended or adjusted under 35 U.S.C. 154(b) by 0 days.

(21) Appl. No.: 10/214,479

(22) Filed: Jul. 31, 2002

(65) Prior Publication Data

US 2004/0020058 A1 Feb. 5, 2004

(51) Int. Cl.
*B26B 1/04* (2006.01)

(52) U.S. Cl. ..... 30/159; 30/160

(58) Field of Classification Search ..... 30/160, 30/161, 159

See application file for complete search history.

(56) References Cited

U.S. PATENT DOCUMENTS

| | | | | |
|---|---|---|---|---|
| 551,052 | A | | 12/1895 | Shonnard et al. |
| 552,928 | A | | 1/1896 | Russel |
| 616,689 | A | | 12/1898 | Ruettgers |
| 1,603,914 | A | | 10/1926 | Hermann |
| 1,701,027 | A | | 2/1929 | Brown |
| 2,263,415 | A | * | 11/1941 | Berg et al. ..... 30/160 |
| 2,407,897 | A | | 9/1946 | Newman |
| 3,868,774 | A | | 3/1975 | Miori |
| 4,451,982 | A | | 6/1984 | Collins |
| 4,604,803 | A | | 8/1986 | Sawby |
| 4,612,706 | A | | 9/1986 | Yunes |
| 4,802,279 | A | | 2/1989 | Rowe |
| 5,095,624 | A | | 3/1992 | Ennis |
| 5,111,581 | A | | 5/1992 | Collins |
| 5,131,149 | A | | 7/1992 | Thompson et al. |
| D336,602 | S | | 6/1993 | Thompson et al. |
| 5,802,722 | A | | 9/1998 | Maxey et al. |
| 5,815,927 | A | | 10/1998 | Collins |
| 6,079,106 | A | | 6/2000 | Vallotton |
| 6,145,202 | A | | 11/2000 | Onion |
| 6,490,797 | B1 | * | 12/2002 | Lake et al. ..... 30/161 |
| 6,591,504 | B1 | * | 7/2003 | Onion ..... 30/160 |
| 6,651,344 | B1 | | 11/2003 | Cheng |

FOREIGN PATENT DOCUMENTS

| | | |
|---|---|---|
| DE | 28765 | 1/1884 |
| DE | 29469 | 6/1884 |
| FR | 493741 | 12/1918 |
| FR | 1069862 | 1/1953 |
| FR | 1171740 | 4/1957 |

OTHER PUBLICATIONS

America's Most Incisive Cutlery Publication, Spring 1992.

* cited by examiner

*Primary Examiner*—Charles Goodman
(74) *Attorney, Agent, or Firm*—Darby & Darby

(57) ABSTRACT

A folding knife according to one embodiment is provided and includes (a) a handle defining a blade cavity; (b) a blade having a first end which is pivotably coupled to the handle about a pivot; and (c) a biasing element disposed within the blade cavity of the handle. The blade has a detent formed therein on a lower edge thereof proximate to the pivot. The biasing element has a fixed first end and an opposing free second end which has a rounded ball member formed thereat. As the blade is closed towards the retracted position, the blade contacts and deflects the second end of the biasing element until the rounded ball member of the second end engages the blade detent, resulting in the blade being held in the retracted position. As the blade is pivotably opened, the rounded ball member of the second end disengages from the detent and energy stored in the deflected biasing element is released and directed into a biasing force against the blade causing the blade to pivot towards the extended position, thereby assisting a user in opening the blade.

25 Claims, 4 Drawing Sheets

10
65
104
112
28
60
122
46
42
24
36
22
110
120
52
20
100
124
114
44
64
66
62
80
71
67
40
32
102
68
4
26
30
34
38
56
54

FIG. 4
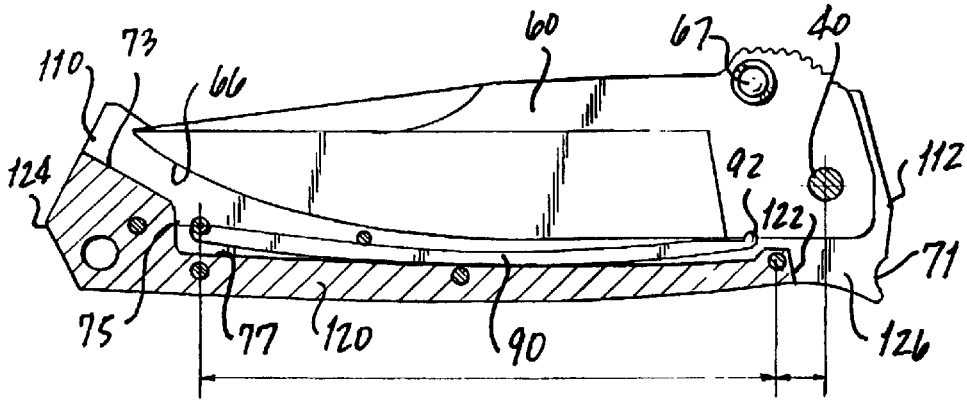
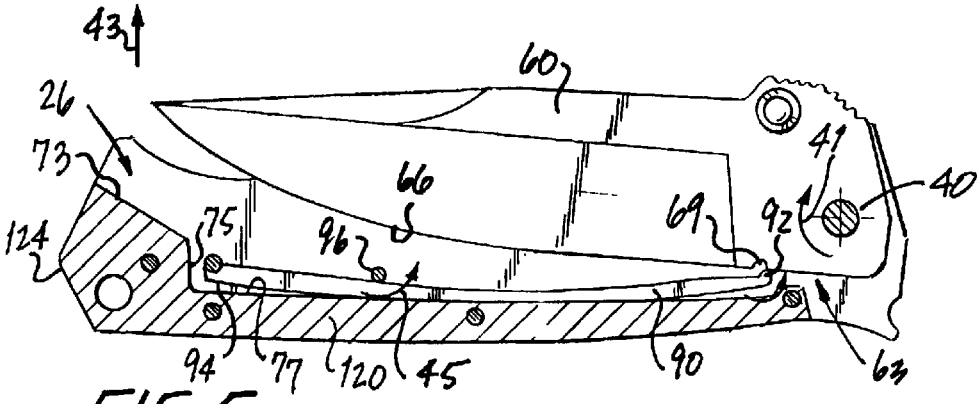
FIG. 5
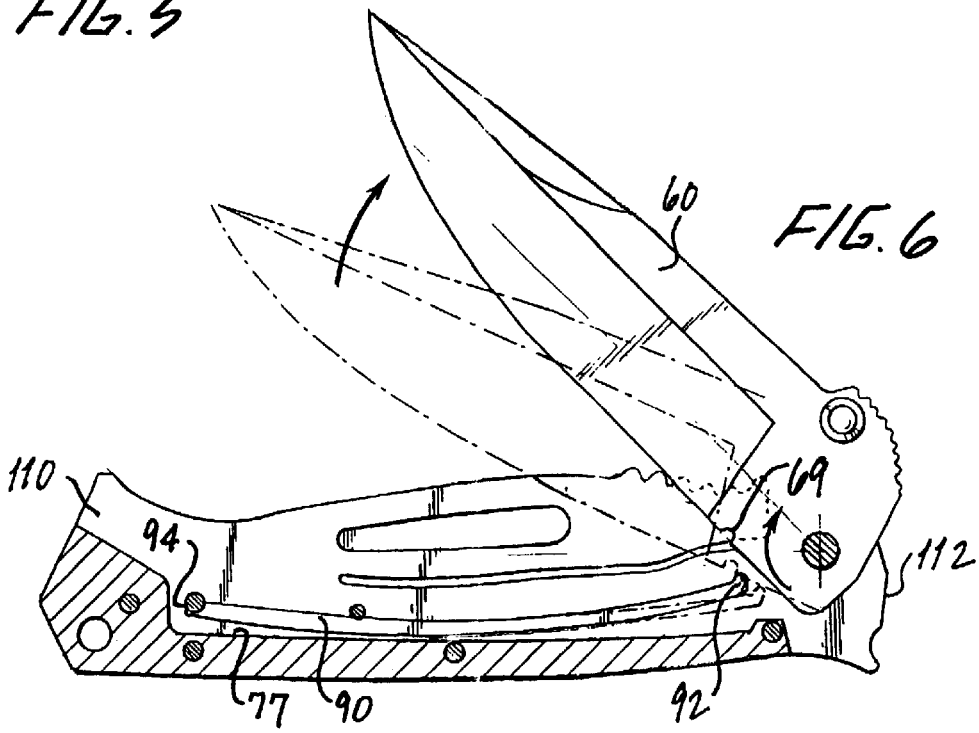
FIG. 6

FOLDING KNIFE HAVING A BIASED BLADE

TECHNICAL FIELD

The present invention relates generally to a folding knife and more particularly, relates to a knife having a biasing element for assisting the user in extending a blade of the knife.

BACKGROUND

A knife is a sharpened instrument typically having a handle portion and a blade. In knives which are not of the foldable or retractable type, the blade permanently extends outwardly from the handle and the knife is stored in a case or the like. Another type of knife is a foldable knife in which the position of the blade may be varied. Folding knives are an attractive option as these types of knives typically permit the blade to be conveniently and safely carried on a person's body (e.g., in a pocket of pants or a jacket) or in a member that is carried by the person (e.g., tackle box, backpack, toolbox, etc.) as well as permitting the knife to be safely stored at a location removed from the person (e.g., drawer, etc.). In many folding knife designs, the blade is positionable between an open position where the blade is extended and a closed position where the blade is retracted into the knife's handle.

A locking mechanism which is part of the handle permits the blade to be locked in the open position as well as the closed position so that the blade cannot freely move and extend from the handle. Folding knives with blades which automatically lock are desirable for safety purposes in that the blade is prevented from closing on the person's hand or fingers during use. However, there may be times when it is not desirable to have the blade locked in the open position, for example, when using the blade for performing a simple task, such as cutting a piece of string or tape or opening a container, like a box. In such situations, closure of the blade would not require the separate deactivation of a blade locking member, which may be the case had the blade been locked.

One of the disadvantages of conventional folding knives is that the task of opening and extending the blade can be a difficult task for some users. For example, this task can require significant pulling force to extract the blade from the folding knife housing. For some users, this is a difficult task and also presents the possibility that the user may become injured while exerting great effort in retracting the blade.

Thus, it would be desirable to provide a folding knife having means for allowing the user to readily open the blade, even when the user is wearing gloves or in situations where the user's hand is disabled to an extent which limits the mobility of the user's fingers in grasping and extracting a conventional blade from a folding knife.

SUMMARY OF THE INVENTION

A folding knife is provided and includes (a) a handle defining a blade cavity; (b) a blade having a first end which is pivotably coupled to the handle about a pivot; and (c) a biasing element disposed within the blade cavity of the handle.

The blade pivots about the pivot between a retracted position where the blade is substantially within the blade cavity and an extended position where the blade is substantially outside of the blade cavity. The blade has a detent formed therein on a lower edge thereof proximate to the pivot. The biasing element is disposed within the blade cavity of the handle. The biasing element has a fixed first end and an opposing free second end which has a rounded ball member formed thereat. As the blade is closed towards the retracted position, the blade contacts and deflects the second end of the biasing element until the rounded ball member of the second end engages the blade detent, resulting in the blade being held in the retracted position due to a contact force being generated between the rounded ball member and at least one surface of the detent. As the blade is pivotably opened, the rounded ball member of the second end slides out of engagement with the detent and energy stored in the deflected biasing element is released and directed into a biasing force against the blade causing the blade to pivot towards the extended position, thereby assisting a user in opening the blade.

Other features and advantages of the present invention will be apparent from the following detailed description when read in conjunction with the accompanying drawings.

BRIEF DESCRIPTION OF THE DRAWINGS

The foregoing and other features of the present invention will be more readily apparent from the following detailed description and drawings of illustrative embodiments of the invention in which:

FIG. 4 is a cross-sectional view of the folding knife of FIG. 3 taken along the line 4—4;

FIG. 5 is a cross-sectional view of the exemplary folding knife with the blade in a first intermediate position;

FIG. 6 is a cross-sectional view of the exemplary folding knife with the blade in a second intermediate position;

DETAILED DESCRIPTION OF THE PREFERRED EMBODIMENTS

Figures 1, 2, 3:
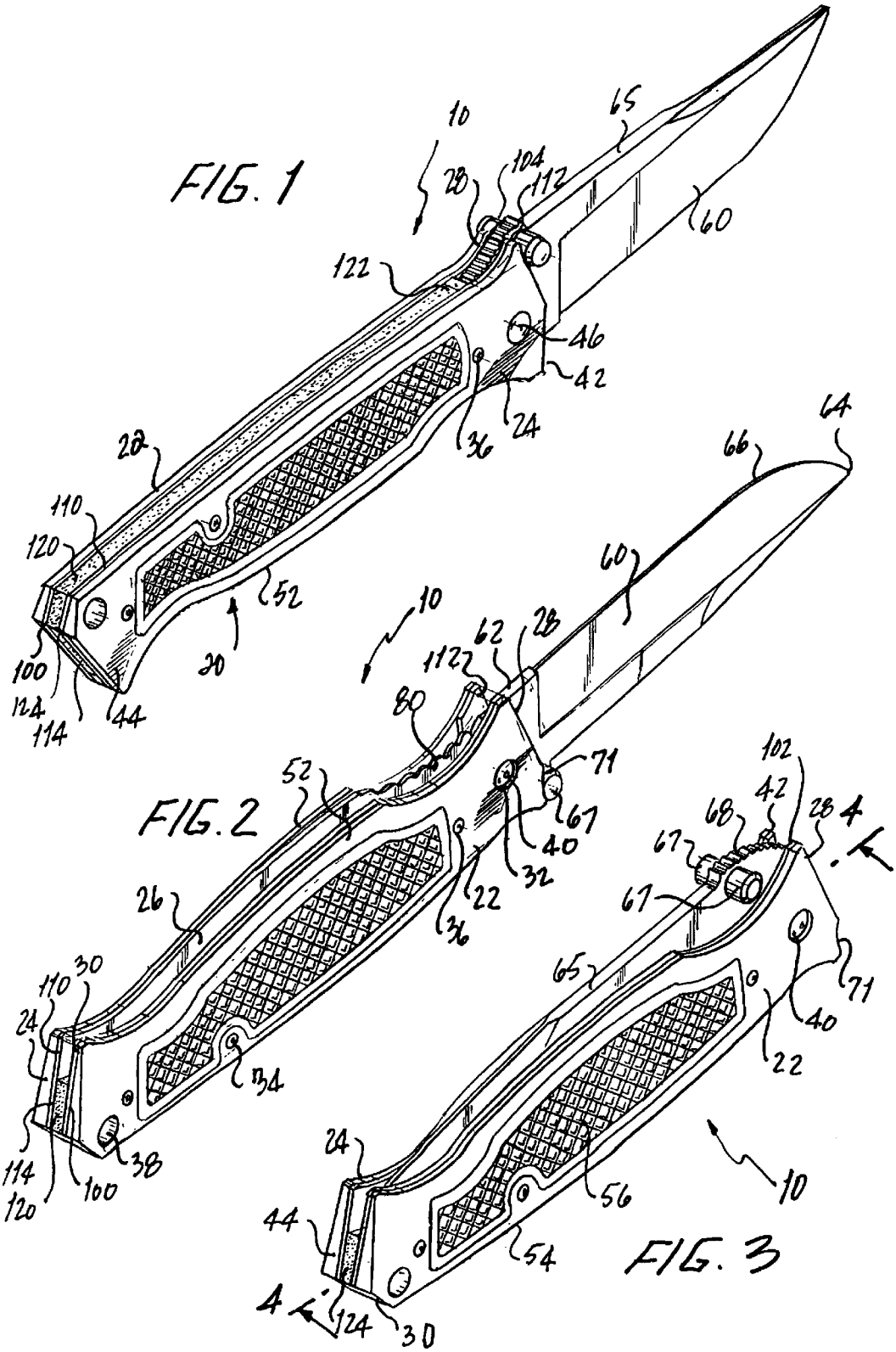
FIG. 1 is a top perspective view of a folding knife according to an exemplary embodiment with a blade of the knife being in an extended position.
FIG. 2 is a bottom perspective view of the folding knife of FIG. 1.
FIG. 3 is a bottom perspective view of the folding knife of FIG. 1 with the blade of the knife being in a retracted position.

Referring first to FIGS. 1 through 3, a biased folding knife according to one exemplary embodiment is generally indicated at 10. The folding knife 10 includes a handle portion 20, a blade 60, a locking feature 80, and a biasing element 90 (FIG. 4) for assisting the user in extending the blade 60 from a retracted position to an extended position.

The handle portion 20 is formed of several components including a first outer handle member 22 and an opposing second outer handle member 24, which preferably are mirror images of one another. The first and second handle members 22, 24 can be formed from any number of suitable materials, including plastics (e.g., fiber reinforced plastics), metals, etc. The handle portion 20 also includes a first inner handle support plate 100 adjacent the first handle member 22, an opposing second inner handle support plate 110 adjacent the second handle member 24 and a handle core 120 disposed between the first and second handle plates 100, 110, which are all preferably formed of metal.

When these handle components are attached to one another, a blade cavity 26 is defined between the first and second inner handle plates 100, 110 and above the handle core 120. The blade cavity 26 is configured to carry the blade 60. The first handle member 22 includes a first end 28 and an opposite second end 30. At the first end 28, an opening 32 is formed for receiving a pin 40 about which the blade 60 pivots as will be described in greater detail hereinafter.

The first handle member 22 also includes a number of openings 34 formed therein which receive fasteners 36 for securely connecting the handle components. For example, screws 36 can be inserted into the openings 34 and used to attach the various handle component to one another. At the second end 30, an opening (bore) 38 is formed in the first handle member 22. The opening 38 can be used to receive a cord or the like to permit the folding knife 10 to be easily worn or hung.

The first inner handle plate 100 is attached to first handle member 22 and preferably is similarly or identically shaped thereto. The first handle plate 100 includes a first end 112 which aligns with the first end 28 and a second end 114 which aligns with the second end 30. A notch 71 is formed at the first end 112. The first inner handle plate 100 receives the fasteners 36, thus securely attaching the first handle member 22 to the first inner handle plate 100 and also receives the pin 40 for permitting the pivoting movement of the blade 60. The first handle plate 100 defines an upper side wall of the blade cavity 26.

The second handle member 24 is preferably a mirror image of the first handle member 22. The second handle member 24 includes a first end 42 and an opposing second end 44 with the first end 42 being spaced from first end 28 and the second end 44 being spaced from the second end 30. At the first end 42, an opening 46 is formed and is axially aligned with the opening 32 so that the pin 40 extends across the handle components with the blade 60 pivoting about the pin 40. The second handle member 24 also contains openings to receive fasteners 36 so as to attach the second handle member 24 to the second inner handle plate 110 as well as other handle components. An opening 38 is formed at the second end 44 for forming the bore that extends through the second ends 30, 44 as well as through the first and second inner handle plates 100, 110 and the core 120.

The second handle plate 110 is disposed adjacent the second handle member 24 and includes a first end 112 which aligns with the first end 42 and a second end 114 which aligns with the second end 44. The first end 112 has a notch 71 formed therein.

The core 120 is preferably a metal core member that extends substantially the length of the folding knife 10. As best shown in FIG. 1, the core 120 has a first end 122 that is orientated near the first ends 28, 42 of the first and second handle member 22, 24 and an opposing second end 124 that preferably aligns with the second ends 30, 44. The first end 122 does not align with the first ends 28, 42 but rather terminates prior to the first ends 28, 42 so that a space 126 (FIG. 4) is formed. The space 126 is designed to permit the blade 60 to pivot into and out of the blade cavity 26 as the blade cavity 26 is formed above the core 120. The core 120 is described in greater detail hereinafter with reference to later figures.

Each of the first and second handle members 22, 24 includes a contoured upper edge 52 and an opposing contoured bottom edge 54. An outer surface of each of the first and second handle members 22, 24 can contain a roughened portion 56 which serves as a gripping portion to assist the user in grasping and holding the folding knife 10. This is particularly helpful when the folding knife 10 is used in less than ideal conditions, such as wet conditions due to rain or the knife 10 being used near a wet environment.

The blade 60 includes a first end portion 62 and a second, tipped portion 64 substantially opposite the first end portion 62. A sharpened cutting edge 66 is provided on blade 60 as part of a lower surface 63 thereof. Opposite the lower surface 63 is an upper surface 65 which includes ridges 68 formed at the first end portion 62. Preferably, the ridges 68 are formed on a curved portion of the upper surface 65 that extends from the first end to a location close to the first end. The ridges 68 act as a thumb engaging portion to which the user applies a force using his/her thumb to cause the blade 60 to close from the extended position. The blade 60 also has a pair of opposing pins 67 that are formed near the inner section of the ridges 68 and protrude outwardly from planar surfaces of the blade 60. The pins 67 are preferably axially aligned with one another and are circular members. Optionally, the pins 67 include a roughened peripheral surface to facilitate a gripping action between the user and the pins 67.

The pins 67 also serve as stoppers that limit the range of the extension of the blade 60, as shown in FIGS. 1 and 2. When the blade 60 is fully extended, the pins 67 engage ends 28, 42 of each of the first and second handle members 22, 24, respectively, as well as ends 102, 112 of the first and second handle plates 100, 110 so as to limit the angle that the blade 60 can extend. As shown in FIG. 3, the ends 28, 42 preferably include a section 71 that is complementary to both the dimensions and the shape of the pins 67. When the blade 60 is fully extended, the pins 67 seat within the sections 71, each of which in the exemplary embodiment is an arcuate notch which mates with the circular pins 67. The notches 71 of the first and second handle members 22, 24 are complementary to and in alignment with the notches 71 of the first and second handle plates 100, 110 to provide notched grooves that receive pins 67.

When the blade 60 is fully retracted, the pins 67 are disposed above the upper edges 52 of the first and second handle members 22, 24. Preferably, the section of each upper edge 52 that is generally below each pin 67 when the blade 60 is fully retracted has a curved profile so as to permit the user to insert his/her fingers under the pins 67, thereby permitting the user to exert pressure on the pins 67 and push the blade 60 into an open position, as will be described in greater detail later. In the fully retracted position, a length of the upper surface 65 of the blade 60 will likely extend above the upper edges 52 of the first and second handle members 22, 24.

Figure 7:
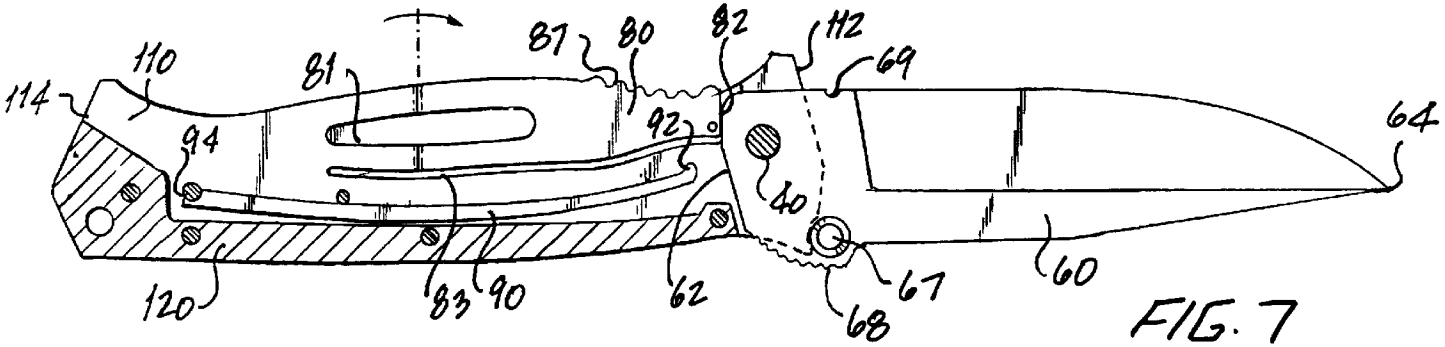
FIG. 7 is a cross-sectional view of the exemplary folding knife with the blade being in an extended position.

FIGS. 4 through 7 illustrate the operation of opening the blade 60 from the fully retracted position of FIG. 4 to the fully extended position of FIG. 7. FIG. 4 is a cross-sectional view taken along the line 4—4 of FIG. 3 and illustrates the core 120 in cross-section. As illustrated in FIG. 4, the second end 124 of the core 120 has a beveled edge 73 that is disposed below the sharped cutting edge 66 at the second, tipped end portion 64. A shoulder 75 is formed at one end of the beveled edge 73 and leads down to a generally planar lower surface 77, which defines in part the blade cavity 26.

The biasing element 90 of the folding knife 10 is disposed in the blade cavity 26 between the first and second handle plates 100, 110. The biasing element 90 has a first end 92 and an opposing second end 94. The second end 94 is fixed in place as by a fastener or the like which attaches to at least the first and second handle plates 100, 110 (FIG. 1) and may further be attached to the first and second handle members 22, 24 (FIG. 1). However, it will be understand that any number of means can be used to fix the second end 94 in place. The first end 92 is in the form of a ball end such that the first end 92 has an arcuate shape and forms an arcuate transverse ridge. The biasing element 90 extends across the blade cavity 26, generally above the planar lower surface 77. The movement of the biasing element 90 is held in place by a pin 96 that is disposed along the length of the biasing element 90 between the first and second ends 92, 94. The biasing element 90 is thus held in place and its range of deflection is limited by disposing the biasing element 90 between the planar lower surface 77 and the pin 96. Preferably, the pin 96 is disposed closer to the attached second end 94 as compared to the first end 92.

According to the illustrated exemplary embodiment, the lower surface 63 of the blade 60 contains a detent 69 formed therein near one end of the sharpened cutting edge 66. The detent 69 is in the form of a notch cut into the blade 60. The exemplary detent 69 has a generally semi-circular shape. In other words, the shape of the detent 69 is complementary to the shape of the first end 92 of the biasing element 90 and therefore, according to the exemplary embodiment, the semi-circular detent 69 is sized and shaped to receive the arcuate ridge that defines the first end 92.

FIG. 4 shows the blade 60 in a retracted position. In this position, the biasing element 90 assumes a deflected position as the closing of the blade 60 causes the first end 92 to be deflected towards the planar lower surface 77. In this retracted position, the arcuate ridge at the first end 92 of the biasing element 90 is disposed within the detent 69 of the blade 60. A length of the deflected biasing element 90 contacts the planar lower surface 77 in this fully retracted position. It will be appreciated that the length of the biasing element 90, as measured longitudinally across the blade cavity 26, varies according to the deflection condition of the biasing element 90. In other words, the straight-line distance between the first and second ends 92, 94 is greatest when the blade 60 is in the fully retracted position, thereby causing deflection of the biasing element 90. The biasing element 90 naturally wants to assume a curled, deflected position and thus when it is deflected, an amount of energy is stored in the biasing element 90. In other words, when the blade 60 is closed, the biasing element 90 is placed in tension along its length because the force created by the detent 69 on ball end 92 of the biasing element 90 causes the biasing element 90 to deflect.

For purpose of simplicity only, FIGS. 5 through 7 illustrate the user grasping the blade 60 near the second, tipped portion 64 thereof; however, it will be understood that the pins 67 are intended to serve as contact points between the user's fingers and the blade 60 to assist the user in opening the blade 60. For example, the user can engage the pins 67 with his/her fingers to exert a force (e.g., a pushing force) on the blade 60 to cause the blade 60 to lift from its retracted position and open.

The blade 60 pivots about the pin 40 as shown by the arrow 41 in FIG. 5 when the user lifts the blade in the direction of arrow 43. The initial deflection direction of the biasing element 90 is illustrated by the arrow 45 and as can be seen, once the tension of the biasing element 90 is slowly released, the biasing element 90 deflects about the pin 96. FIG. 5 illustrates the arcuate ridge at the first end 92 of the biasing element 90 moving along the curved surface of the detent 69 to a location where the first end 92 is just free of the detent 69 and engages the generally planar lower surface 63 of the blade 60. This relative movement between the first end 92 and the detent 69 is caused by the user opening the blade 60 in the direction 43.

Because the first end 92 is in the form of an arcuate ridge, the first end 92 can effectively roll against an opposing surface, such as the detent 69 and/or the planar surface 63. Another advantage of forming the first end 92 to have arcuate features which complement the arcuate features of the detent 69 is that the first end 92 is permitted to move within the detent 69 and slide into and out of the detent 69 with some ease. Conversely, if the first end 92 and detent 69 had sharp edges, such movement would not be possible and once the first end 92 aligned with the detent 69, the first end 92 would fall into and engage the detent 69 but would not easily become disengaged therefrom.

FIG. 6 shows further opening of the blade 60 with a first position of the blade 60 being shown in phantom and a next second position of the blade 60 being shown. As the blade 60 opens, the first end 92 of the biasing element 90 travels along the planar surface 63 as the biasing element 90 continuously deflects due to a release of the energy stored in the biasing element 90. The deflection direction of the biasing element 90 is in the same general direction as the direction that the user is pulling the blade 60 and thus, the deflection of the biasing element 90 and its contact with the blade 60 as it deflects, actually assists the user in opening the blade 60 to the fully extended position shown in FIG. 7. As will be described in greater detail hereinafter, once the first end 92 of the biasing element 90 clears the detent 69, the deflection force generated by the biasing element 90 pushes the blade 60 outwardly towards the fully extended position.

As the blade 60 is opened, there comes a point where the first end 92 of the biasing element 90 becomes removed from contact with the planar surface 63 due to a number of factors, including the length of the biasing element 90, the angle of the blade 60 relative to the lower surface 77, the location of the pivot point (pin 40) of the blade 60 relative to the biasing element 90, etc. Once the first end 92 is no longer in contact, the biasing element 90 assumes its rest position, where any stored energy has been released (as best shown in FIG. 7). The blade 60 continues to pivot about pin 40 until the blade assumes the fully extended position shown in FIG. 7. As will be described later, the locking feature 80 engages the first end 62 of the blade 60 to effectively releasably lock the blade 60 in the fully extended position. In this fully extended position, the first end 92 of the biasing element 90 and the first end 62 of the blade 60 are spaced from one another.

Figure 8:
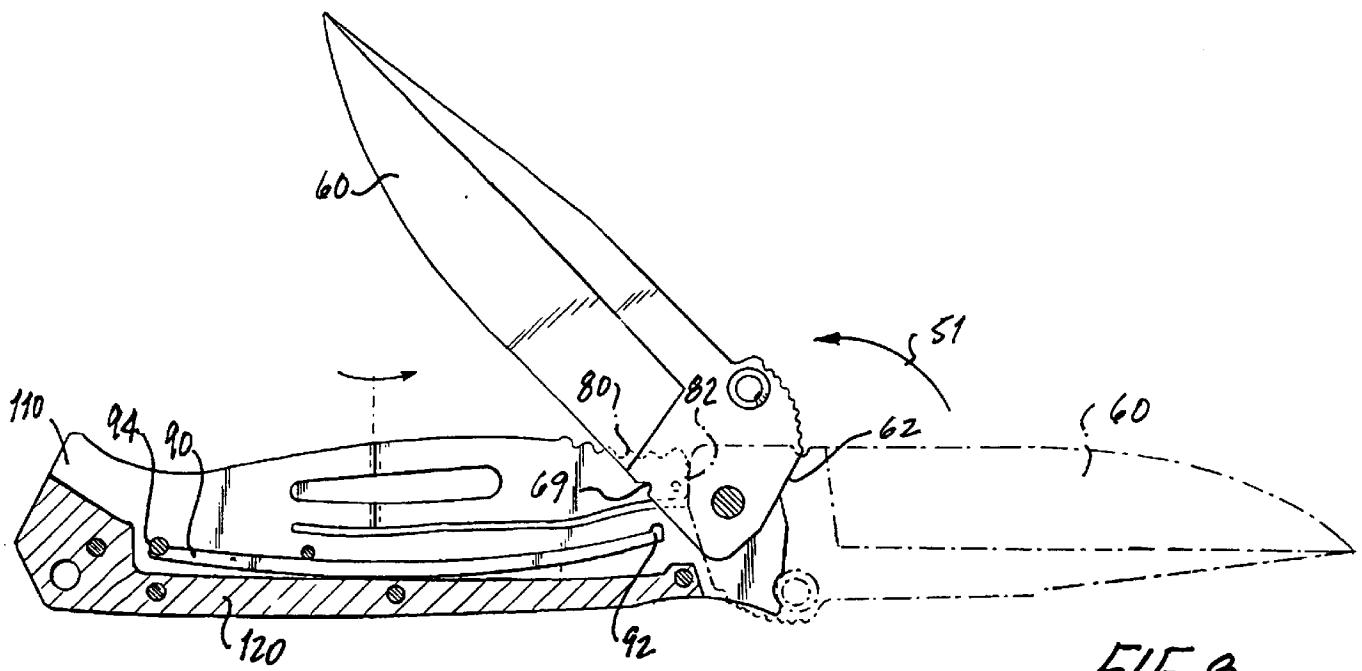
FIG. 8 is a cross-sectional view of the exemplary folding knife with the blade being moved to a first intermediate position as the user closes the blade.
Figure 9:
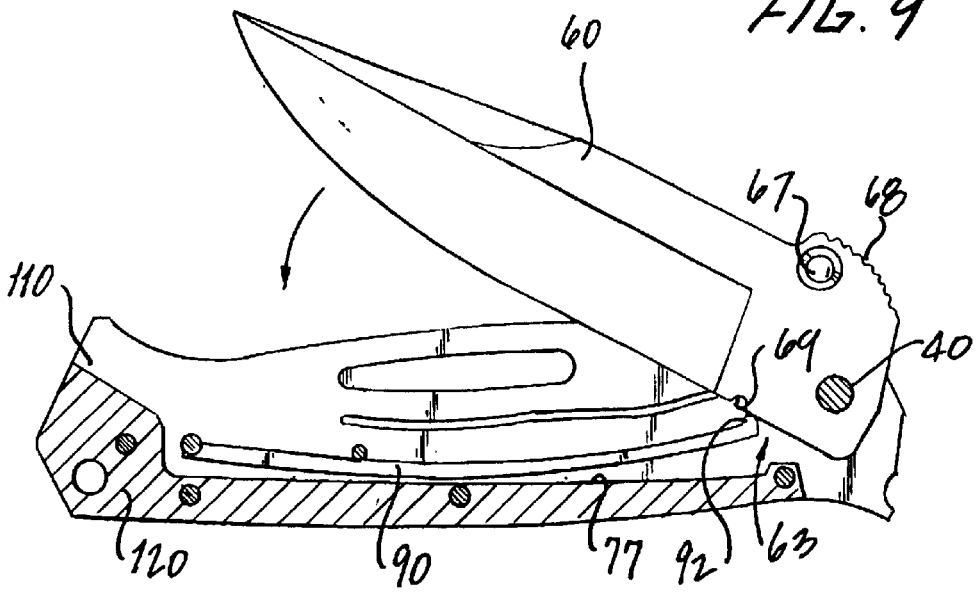
FIG. 9 is cross-sectional view of the exemplary folding knife with the blade being further closed to a second intermediate position with the blade contacting a biasing element of the knife.
Figure 10:
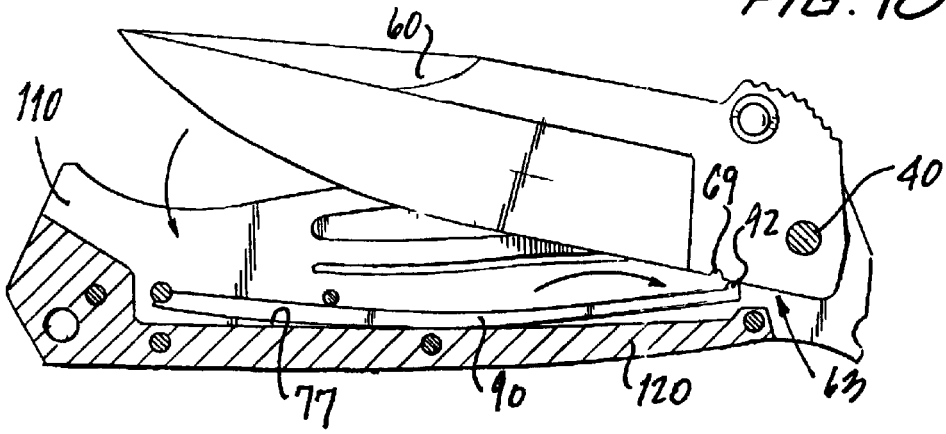
FIG. 10 is a cross-sectional view of the exemplary folding knife with the blade being further closed to a third intermediate position with the biasing element being deflected.
Figure 11:
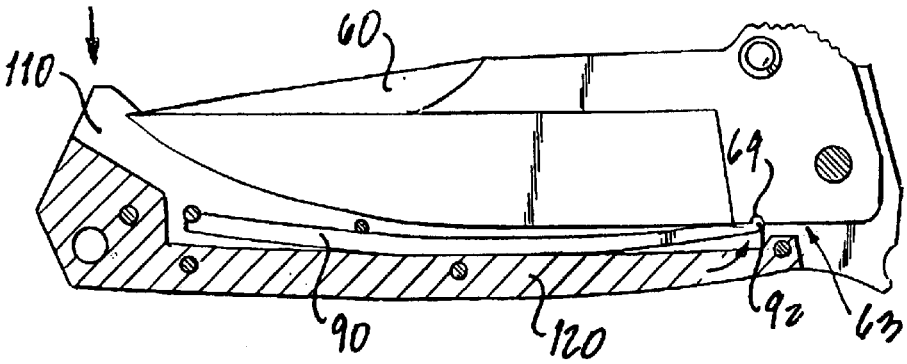
FIG. 11 is a cross-sectional view of the exemplary folding knife with the biasing element being further deflected and in engagement with the blade.

FIGS. 8 through 11 illustrate the closing of the blade 60 from the fully extended position (in phantom in FIG. 8) to the fully retracted position of FIG. 11. To close the blade 60, the locking feature 80 is first released, thereby permitting the blade 60 to move in a closing direction, generally indicated by arrow 51. Once again, FIGS. 8 through 11 show the user's fingers grasping the blade 60 near the second end 64 for purpose of illustration only and it will be appreciated that the user can use pins 67 and ridged section 68 for closing the blade 60. FIG. 8 shows an intermediate position of the blade 60, where the blade 60 is not yet in contact with the biasing element 90, which is in a relaxed position.

FIG. 9 shows the further closing action of the blade 60 with the blade 60 being pivoted about the pin 40 and into contact with the biasing element 90. More specifically, the first end 92 of the biasing element 90 contacts the planar surface 63 outside of the detent 69. As previously, mentioned, the arcuate features of the first end 92 permit the first end 92 to slide along planar surface 63 as the blade 60 is retracted. Once the blade 60 contacts the first end 92, a force is applied against the biasing element 90 to cause deflection of first end 92 of the biasing element 90 in a direction towards the planar lower surface 77.

The blade 60 is shown in a further closed position in FIG. 10. In this position, the biasing element 90 is further deflected (resulting in more energy being stored therein) at the first end 92 and the arcuate ridge formed at the first end 92 remains in contact with the surface 63. As one will appreciate the straight-line distance between the ends 92, 94 of the biasing element is greater in the condition of the biasing element in FIG. 10 compared to the condition of FIG. 9. In other words, the biasing element 90 is being compressed to a deflected position, where the biasing element 90 is "straighter".

FIG. 11 shows the blade 60 in its fully retracted position. The exemplary folding knife 10 is configured such that the blade 60 rests in the fully retracted position even though the biasing element 90 remains deflected (compressed) in this position. This is a result of a number of characteristics that are associated with the biasing element 90 and the location of the detent 69. More specifically and as previously-mentioned, the length of the biasing element 90 varies as it becomes more and more deflected, with the length of the biasing element 90 increasing as it further deflects. Once the biasing element 90 is fully deflected and the blade 60 is further pivoted during the closing operation, the detent 69 effectively "catches up" with the second end 92 such that when the blade 60 is completely in the closed (horizontal) position, the detent 69 effectively is aligned with the second end 92. More specifically, after the biasing element 90 assumes the deflected position, the further pivoting of the blade 60 causes the detent 69 to rotate into engagement with the second end 92.

Thus, the slope of the detent 69 relative to the degree of curvature of the first end 92 is such that, in the fully retracted position, the biasing element 90 generates a contact force on the blade 60 that acts generally horizontal, as indicated by the arrow 53, and this causes a moment (torque) where the blade 60 is urged in a counter-clockwise direction. At the same time, the biasing element 90 has an upward force component; however, this upward force component is overcome by the generally horizontal contact force generated between the biasing element 90 and the blade 60. This results in the blade 60 remaining in the closed, fully retracted position. The location of the detent 69 and the length of the biasing element 90 should be selected so that in the fully retracted position, the upward deflection force of the first end 92 is overcome by a counterforce, thereby permitting the first end 92 to seat against the blade 60 without causing a clockwise, opening motion by the blade 60. The location of the detent 69 relative to the pivot point (i.e., pin 40) of the blade 60 is also carefully selected such that the above-described forces result and the blade 60 remains in the closed position.

In order for the upward force component of the biasing element 90 to overcome the generally horizontal force component, the length of the biasing element 90 must decrease; however, the seating position of the first end 92 within the detent 69 does not permit such length reduction. However, once the user lifts the blade 60 slightly and begins to pull the blade 60 in a clockwise direction, the first end 92 is freed from its static position within the detent 69 and is free to move within the detent 69. Accordingly, the length of the biasing element 90 can now decrease and as it decreases, the first end 92 tracks along the sloped surface of the detent 69. As the first end 92 moves along the detent 69, the horizontal force component is reduced or eliminated, thereby resulting in the upward force component being the predominant force component generated by the biasing element 90. This upward deflection force continues as the first end 92 clears and is free from the detent 69 and contacts the surface 63. In other words, once the first end 92 is removed from the position where the upward deflection force is the inferior force and is placed in a position where the upward deflection force is the superior force, the natural deflection of the biasing element 90 acts against the blade 60 to cause a clockwise rotation of the blade 60 about the pivot 40.

In one exemplary embodiment, the biasing element 90 comprises a an elongated spring element; however, it will be understood that a number of different springs having different configurations can be used, e.g., a leaf spring, so long as the spring functions in the manner described hereinbefore.

The biasing element 90 is thus configured to assist the user in opening the blade 60 by applying a force (in the clockwise direction) to the blade 60. The biasing element 90 thus provides a very simple yet effective mechanism for assisting the user in opening the blade 60. This overcomes the disadvantage of conventional folding knives in which a significant amount of force is needed to pull the blade from the fully retracted position to a fully extended position. For some individuals, the opening of the blade can be a difficult task and thus, the present arrangement provides a folding knife which can be used easily by a larger number of the consumers.

Referring to FIGS. 6–11, the second inner handle plate 110 has an automatic locking feature 80 that serves to releasably lock the blade 60 in the fully extended position. FIG. 7 shows the locking feature 80 engaging the blade 60 so as to effectively lock the blade 60 in the fully extended position. The operation of the locking feature 80 is best illustrated in reference to FIGS. 6 through 11. The locking feature 80 is formed near the first end 112 of the second inner handle plate 110 opposite the second end 114 which is fixed in position. The first end 112 aligns with the first end 42 of the second handle member 24 (FIG. 1); however the locking feature 80 is formed prior to the first end 112 and is constructed so as to permit a portion of the second inner plate 110 to be flexedly biased proximate to the pivotal first end 62 of the blade 60.

The locking feature 80 is constructed so that it is a biased member (e.g., a tongue like member) that is formed as part of the second handle plate 110 with the locking feature 80 being positionable between a lock position and an unlock position. Because the locking feature 80 is formed as part of the second inner handle plate 110, the locking feature 80 extends a length of the blade cavity 26 and as shown in the Figures, and the locking feature 80 extends along the blade cavity 26 on one side of the biasing element 90.

The locking feature 80 is formed by altering the construction of the second inner handle plate 110 so as to create a biased tongue that flexes inwardly and outwardly near the first end 62 of the blade 60 depending upon the position of the blade 60. For example, the locking feature 80 (biased tongue) can be formed by forming one or more openings 81 and one or more slots 83, to create the biasing characteristics of the locking feature 80. The locking feature 80 has a locking surface 82 that preferably has a complementary surface profile as the first end 62 of the blade 60 (as shown in FIG. 7) so that the locking surface 82 becomes flexedly displaced in the blade cavity 26 and seats against or at least along the axis of rotation of the blade 60. The locking surface 82 is actually an end of the biased tongue-like structure 80 and thus the locking surface 82 creates interference with the blade 60 and prevents pivoting movement of the blade 60 once the locking feature 80 assumes this locked position. This acts as a safety mechanism in that the blade 60 is prevented from freely pivoting out of the fully extended position (the position where the knife is being used in some capacity) even if the blade 60 contacts an object and/or a force is applied to the blade 60 in a direction that normally would pivot the blade 60.

The locking feature 80 is constructed so that in the normal rest position, the locking feature 80 assumes a deflected position where the locking surface 82 flexes inwardly into the blade cavity 26 and into a position where the aforementioned interference is created between the locking surface 82 and the blade 60. In other words, the locking feature 80 is naturally biased so that it assumes a position with the locking feature 80 (and locking surface 82) being inwardly deflected unless some interference is created to prevent the locking feature 80 from assuming this deflected position. When the blade 60 is in the retracted position (FIG. 4) and when the blade 60 is being pivotally opened, the blade 60 itself creates the interference with the locking feature 80 that prevents the locking feature 80 from assuming the deflected position. This interference results because the feature 80 is formed as part of the second inner handle plate 110 that is axially disposed on one side of the blade 60.

The locking feature 80 has a roughened surface profile 87 at an upper edge thereof near the locking surface 82 to assist the user in disengaging the locking feature 80 from its locked position and thereby free the blade 60 for pivoting movement. To move the locking feature 80 from the locked position to the unlocked position, the user simply contacts the profile 87 and applies a force in the direction towards the second handle member 24, thus causing the locking feature 80 to flex outwardly. In other words, the user overcomes the biasing force by applying a greater force in an opposite direction as the direction of the biasing force. The locking surface 82 disengages from the first end 62 of the blade 60, thereby permitting the blade 60 to pivotally rotate about 40 and into the blade cavity 26. Once the locking feature 80 is removed from the axis of rotation of the blade 60, the blade 60 can freely pivot into the cavity 26 where it then makes contact with the biasing element 90 as previously described. Once the first end 62 of the blade 60 is pivoted a predetermined amount, it becomes disposed within the cavity 26 so as to prevent the locking feature 80 from flexing inwardly and therefore, the user can remove the applied force to the locking feature 80. The locking feature 80 will likely flex slightly inward once the applied force is removed; however, the locking feature 80 will encounter the first end 62 of the blade 60, which prevents its further inward flexing, while permitting the blade 60 to continue to pivotally rotate.

The present folding knives thus provide reliable, easy to use folding knives that each includes a biased blade to assist the user in opening the blade and also a locking feature that is biased such that it automatically locks the blade when the blade is opened.

While the invention has been particularly shown and described with reference to preferred embodiments thereof, it will be understood by those skilled in the art that various changes in form and details may be made therein without departing from the spirit and scope of the invention.

What is claimed is:

1. A folding knife comprising:

a handle defining a blade cavity;

a blade having a first end which is pivotably coupled to the handle about a pivot and a second end which includes a sharpened edge, the blade pivoting about the pivot between a retracted position where the blade is substantially within the blade cavity and an extended position where the blade is substantially outside of the blade cavity, the blade having a detent formed therein on a lower edge thereof proximate to the pivot; and a biasing element disposed within the blade cavity of the handle, the biasing element having a fixed first end and an opposing free second end which has a profile, wherein as the blade is closed towards the retracted position, the blade deflects the second end of the biasing element until the profile of the second end engages and is retained within the blade detent, resulting in the blade being held in the retracted position, and wherein as the blade is pivotably opened, the profile of the second end becomes disengaged from the detent and energy stored in the deflected biasing element is released and directed into a biasing force that pivots the blade towards the extended position, thereby assisting a user in opening the blade.

2. The folding knife of claim 1, wherein the handle includes a core member defining a lower surface of the blade cavity and at least one handle member disposed on each side of the core.

3. The folding knife of claim 2, wherein the blade pivot extends through the handle members and the core at one end thereof.

4. The folding knife of claim 1, wherein the blade pivot comprises a pin extending across the blade cavity of the handle, the blade being pivotably rotated about the pin.

5. The folding knife of claim 1, wherein the blade includes a pair of opposing pins extending outwardly from an outer surface of the blade proximate the first end of the blade.

6. The folding knife of claim 1, wherein the detent comprises a notch formed in the lower surface of the blade.

7. The folding knife of claim 6, wherein the notch has an arcuate shape.

8. The folding knife of claim 2, wherein the biasing element is disposed between the blade and the lower surface of the blade cavity.

9. The folding knife of claim 1, wherein the biasing element comprises an elongated leaf spring.

10. The folding knife of claim 1, wherein the first end of the biasing element is fixed by a pin.

11. The folding knife of claim 1, further including:

a retaining pin disposed above the biasing element but below the blade, the retaining pin limiting upward movement of the biasing element while creating a pivot point about which the biasing element pivots.

12. The folding knife of claim 1, wherein the profile of the second end of the biasing element comprises an arcuate ridge.

13. The folding knife of claim 1, wherein the biasing element generates in the retracted position a deflection force which is less than or equal to a contact force generated between the second end of the biasing element and the detent of the blade resulting in the blade remaining in the retracted position.

14. The folding knife of claim 13, wherein the deflection force is generated in a direction away from a lower internal surface of the handle, the biasing element being disposed between the lower surface and the blade.

15. The folding knife of claim 1, wherein the second end of the biasing element has a shape complementary to a shape of the detent to permit reception and retention of the second end within the detent.

16. The folding knife of claim 13, wherein the detent has a first sloped section such that in the retracted position, the second end of the biasing element is urged against the sloped section, thereby generating the contact force.

17. The folding knife of claim 1, wherein in the retracted position, a length of the biasing element between the first and second ends seats against a lower internal surface of the handle.

18. The folding knife of claim 1, further including:

a locking member formed as part of the handle, the locking member automatically biased to the locking position once the blade pivotally clears a locking surfaces of the locking member as the blade is pivotally opened.

19. The folding knife of claim 18, wherein the locking member comprises a biased tongue defined by a slot formed in an inner handle plate that defines one side of the blade cavity and is a part of the handle.

20. The folding knife of claim 1, wherein the biasing element pivots in a counter clockwise direction and the blade pivots in a clockwise direction when the blade is opened from the retracted position.

21. The folding knife of claim 1, wherein the second end of the biasing element contacts and applies biasing force against a section of the lower surface of the blade extending between the detent and the first end of the blade.

22. A folding knife comprising:

a handle defining a blade cavity;

a blade having a first end which is pivotably coupled to the handle about a pivot and a second end, the blade pivoting about the pivot between a retracted position where the blade is substantially within the blade cavity and an extended position where the blade is substantially outside of the blade cavity, the blade having a detent formed therein on a lower edge thereof proximate to the pivot; and a biasing element disposed within the blade cavity of the handle, the biasing element having a fixed first end and an opposing free second end which has a rounded ball member formed thereat, wherein as the blade is closed towards the retracted position, the blade contacts and deflects the second end of the biasing element until the rounded ball member of the second end engages the blade detent, resulting in the blade being held in the retracted position due to a contact force being generated between the rounded ball member and at least one surface of the detent, and wherein as the blade is pivotably opened, the rounded ball member of the second end slides out of engagement with the detent and energy stored in the deflected biasing element is released and directed into a biasing force against the blade causing the blade to pivot towards the extended position, thereby assisting a user in opening the blade.

23. A folding knife comprising:

a handle defining a blade cavity;

a blade having a first end which is pivotably coupled to the handle about a pivot and a second end which includes a sharpened edge, the blade pivoting about the pivot between a retracted position where the blade is substantially within the blade cavity and an extended position where the blade is substantially outside of the blade cavity, the blade including a receiving feature formed therein along one edge thereof proximate to the second end; and a biasing element disposed within the blade cavity of the handle, the biasing element having a fixed first end and an opposing free second end which has an engaging feature formed thereat such that as the blade is closed towards the retracted position, the blade deflects the second end of the biasing element causing the engaging feature to travel along the one edge until it engages and is retained within the receiving feature, resulting in the blade being held in the retracted position, and wherein as the blade is pivotably opened, the engaging feature clears the receiving feature and energy stored in the deflected biasing element is released and directed against the blade as a biasing force that pivots the blade towards the extended position, thereby assisting a user in opening the blade.

24. The folding knife of claim 23, wherein the engaging feature comprises a rounded protrusion formed at the second end.

25. The folding knife of claim 23, wherein the receiving feature comprises a curved notch formed in a lower edge of the blade.

* * * * *